US005984015A

United States Patent [19]

Vieregge

[11] Patent Number: 5,984,015

[45] **Date of Patent: *Nov. 16, 1999**

[54] PIPEWORK FOR SPRINKLER SYSTEMS

[76] Inventor: Uwe Vieregge, Kantstr. 10, D-63584 Gründau, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,447

[22] PCT Filed: Mar. 13, 1995

[86] PCT No.: PCT/EP95/00924

§ 371 Date: Sep. 19, 1996

§ 102(e) Date: Sep. 19, 1996

[87] PCT Pub. No.: WO95/25923

PCT Pub. Date: Sep. 28, 1995

[30] Foreign Application Priority Data

Mar. 23, 1994 [DE] Germany ..... 44 09 904

[51] Int. Cl.[6] ..... A62C 35/68

[52] U.S. Cl. ..... 169/16

[58] Field of Search ..... 169/5, 16, 17, 169/18

[56] References Cited

FOREIGN PATENT DOCUMENTS 5-31208 2/1993 Japan ..... 169/16

91/16949 11/1991 WIPO ..... 169/16

*Primary Examiner*—Andrew C. Pike

*Attorney, Agent, or Firm*—Bierman, Muserlian and Lucas

[57] ABSTRACT

Pipework (10, 12) for sprinkler systems comprises pipes (20,24,26,28,32) leading from a supply line (14) conveying extinguishing liquid and displaceable about mutually parallel axes (44,46,48,50). A union runs from the supply line and an end pipe (28) to which a sprinkler head can be fitted. To ensure that the displaceable pipes are highly variable, at least one of the pressurized displaceable pipes is a U-shaped pipe (20,26). The arms (18,22) of the pipe are connectors for at least one further pipe (24,28) and/or the union (16) which is secured to the U-shaped pipe in a pressure tight connection via plug-in connectors (34,36,38,40,42).

12 Claims, 2 Drawing Sheets

PIPEWORK FOR SPRINKLER SYSTEMS

The invention relates to pipework for sprinkler systems, comprising a supply line conveying an extinguishing fluid, a sprinkler head extending from an end piece, and pipes running between the end piece and a connecting piece extending from the supply line, said pipes being swivelable about first axes parallel to one another and preferably vertical, where of the swivelable pipes at least one is a first U-shaped pipe with second and first side arms, of which at least one (first) side arm is a receiver for at least one further (second) swivelable pipe that is connectable in pressuretight manner to the U-shaped pipe by a plug-in connection.

Corresponding pipework is described in WIPO 91/16949. In this case, L-shaped pieces and Z-shaped pipes can be combined into U-shaped pipes that are connected in turn to a sprinkler head by S-shaped intermediate sections. Before final assembly, the loosely assembled pipes can be swiveled about vertically running axes such that the sprinkler head is at a required distance from the supply line. The pipes are then firmly connected to one another using screw elements to achieve the requisite tightness.

It is furthermore possible to achieve a height adjustment of the sprinkler head. To do so, a vertically running pipe is designed as a telescopic pipe.

If the screws are not sufficiently tightened after adjustment, there is a danger that when the pipework is subjected to pressure, the pipes will slip apart and extinguishing fluid will leak out uncontrolled.

Pipework for sprinkler systems is known from French Patent No. 2,306,716 in which telescopic pipes are connected to one another using a union nut. Loosening of the union nut or adjustment of the pipes when pressure is applied to the pipework is not possible.

Other pipe connections, though not relating to sprinkler systems, are described in French No. 2,348,426, No. 2,038,071, or No. 1,256,926. However, with the previously known measures, it is possible neither to adjust the entire pipework when it is under pressure nor to vary the input and output points of the pipework in either the horizontal or vertical direction.

The problem underlying the present invention is to develop pipework for sprinkler systems of the type described above such that even in restricted spaces there exists a high variability of the possible settings for the sprinkler head even in sprinkler systems that are already in use, depending on the swivelable pipes used. In addition, the connection between the individual pipes should meet standard safety requirements with a simple construction.

The problem is solved in accordance with the invention in that the plug-in connection is a snap-type connection comprising a snap ring, and in that the pipes connected using said snap-type connection are swivelable in relation to one another about the first axes when under pressure caused by extinguishing fluid.

The teachings in accordance with the invention result in the advantage that the pipes are swivelable in relation to one another also when under pressure in order to set the required distance between the sprinkler head and the supply line. Thanks to the use of a snap-type connection, there is furthermore the advantage that pipes cannot slip apart in uncontrolled manner. In particular however, there is the advantage that subsequent adjustment of the sprinkler head is also possible in a sprinkler system already in operation.

In accordance with a proposal that is inventive per se, it is provided that the pipework comprises at least two U-shaped pipes and an L-shaped running between them, and that the pipes connected by the plug-in connections of snap-type comprising a snap ring design are swivelable when under pressure caused by extinguishing fluid, with at least one U-shaped pipe being swivelable both about first axes and about at lest one second axis running vertical to the first axes.

These measures provide the possibility of adjusting the sprinkler head both horizontally and vertically in very confined spaces, even when the pipework is under pressure from extinguishing fluid.

In particular, it is provided that the sprinkler head aligned vertically or substantially vertically with its longitudinal axis can be altered in its distance from the supply line by swiveling the pipes both about the first vertical axis and about the second horizontal axis.

To provide an absolutely tight and unreleasable plug-in connection, it is provided that in an all-round inner groove of the receiver the snap ring is arranged engaging partly in an all-round outer groove of the further pipe or connecting piece when the end of said further pipe or connecting piece is seated in the receiver. The snap ring creates a rotating snap-type connection between the pipes that is as a general principle unreleasable, since the snap ring extends regionally both inside the outer groove of the further pipe or connecting piece and inside the inner groove of the U-shaped pipe.

To seat the further pipe or connecting piece simply inside the receiver, without obstruction from the snap ring being possible, it is provided that the respective free end of the further pipe or connecting piece be chamfered.

To ensure the necessary sealing between the pipes, a further inner groove receiving a seal such as an O-ring is provided in the receiver, which, however, is further away from the opening of the receiver compared with the first inner groove.

To permit fixing of the mutually swivelable pipes in relation to one another as soon as the sprinkler head is set in the required position, a fixing element preferably in the form of a grub screw with cup point extends from the outer wall of the receiver and presses into the outer wall of the further pipe or connecting piece.

The further pipe can be a Z-shaped pipe having a Z shape or an angled pipe having an L shape. The L-shaped pipes here either make connections between U-shaped pipes or between a U-shaped pipe and an end pipe. If the L-shaped pipe is a connecting pipe between U-shaped pipes, its ends are connectable in receivers of U-shaped pipes using plug-in connections of the type described above.

Z-shaped pipes are designed with receivers at their one end, while the other end fits into a receiver of a U-shaped pipe.

To permit adjustment of the sprinkler head both in its height in relation to the supply line and in its lateral distance from the latter, it is provided that the pipework comprises at least one connecting piece, two U-shaped pipes, and two L-shaped pipes.

If, however, only a change in the lateral distance of the sprinkler head from the supply line is required, without variation being possible of the distance between the plane within which the sprinkler head is swivelable and the supply line, the pipework comprises at least one connecting piece, one U-shaped pipe, and one Z-shaped pipe.

Further advantages of the invention are shown not only in the claims and in the features therein, singly and/or in combination, but also in the design examples shown in the drawing.

IN THE DRAWING

Figure 1:
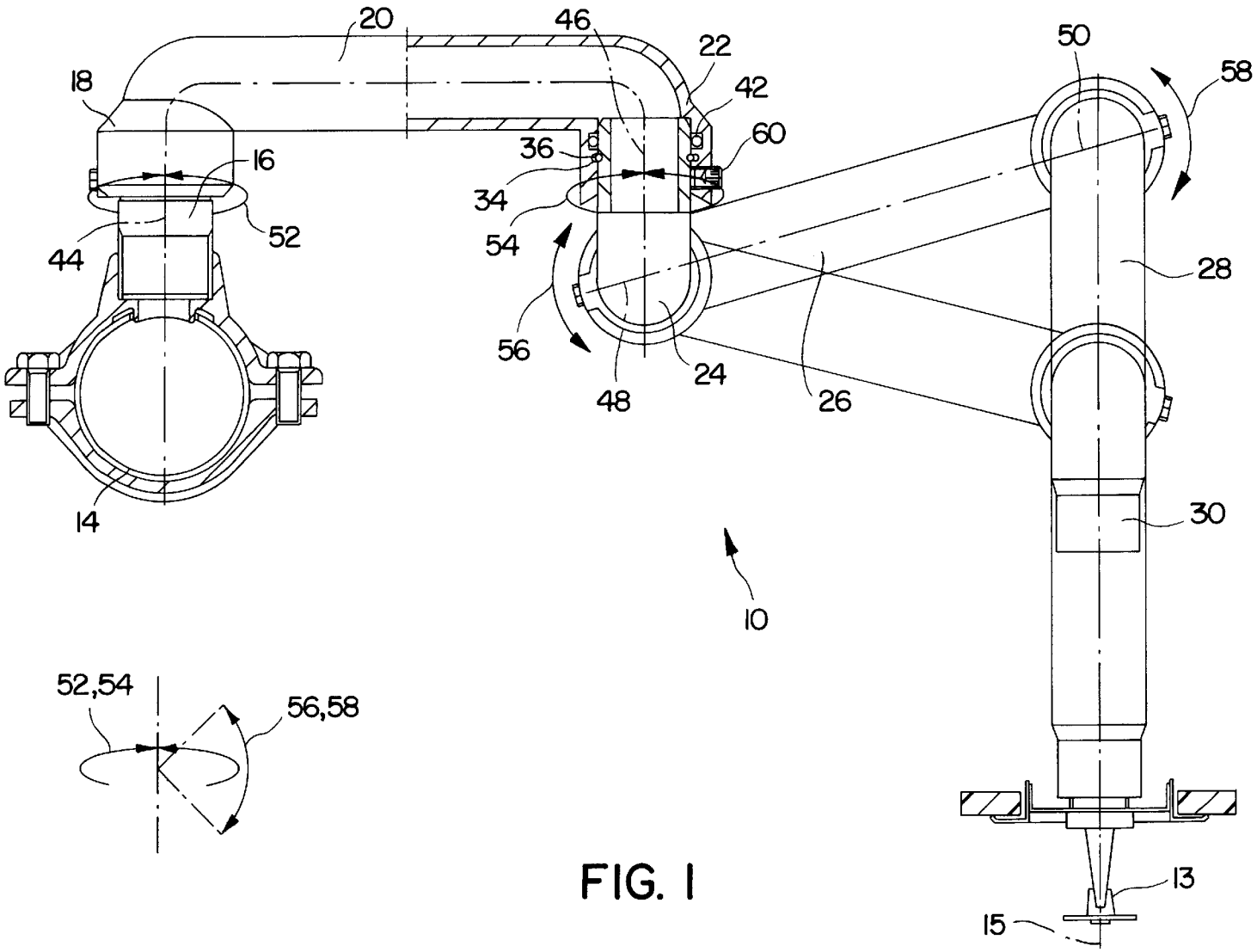
FIG. 1 shows a first embodiment of pipework for sprinkler systems.
Figure 2:
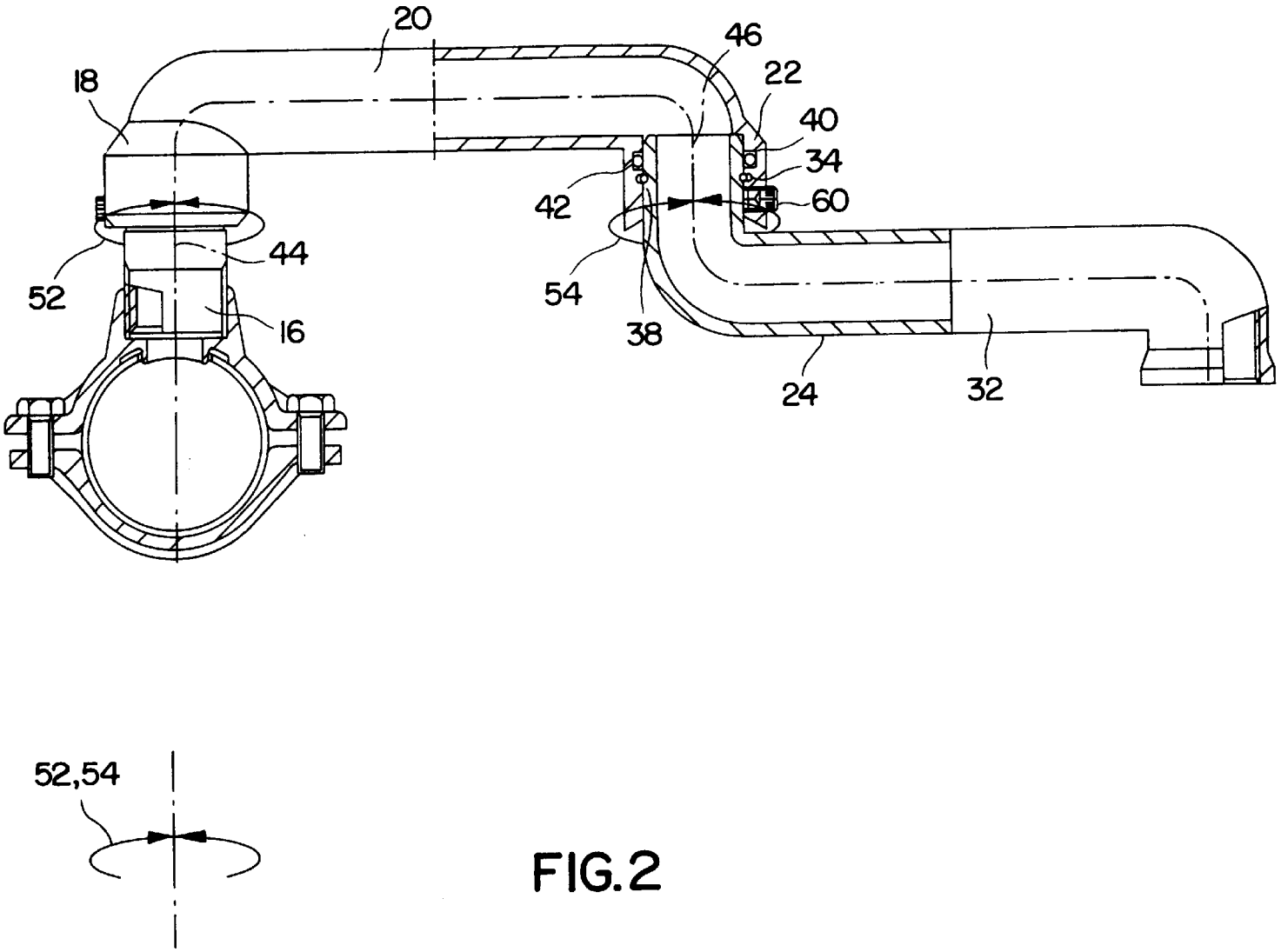
FIG. 2 shows a second embodiment of pipework for sprinkler systems.

In the FIGURES, in which identical elements have the same reference numbers, pipework arrays (10) and (12) are shown that are intended for sprinkler systems and with which the distance of a sprinkler head (13) shown purely in principle in FIG. 2 is adjustable in relation to a supply line (14) conveying a extinguishing fluid either laterally only (FIG. 2) or both laterally and in height (FIG. 1).

In the embodiment in FIG. 1, the pipework array (10) comprises a connecting piece (16) extending from the supply line (14) and engaging in a side arm (18) of U-shaped pipe (20) in the manner described below. The remaining side arm (22) of the U-shaped pipe (20) is also designed as a receiver, with an angled pipe (24) having an L shape being inserted in the design example.

The L-shaped pipe (24) is connected to a further U-shaped pipe (26) corresponding to the U-shaped pipe (20), and having parallel side arms not described in detail that are likewise designed as receivers. Finally, a second L-shaped pipe (28) extends from the second U-shaped pipe, to the free end (30) of which L-shaped pipe the sprinkler head (13) is attachable in the usual way and the longitudinal axis (15) of which head is an a general principle either vertical or substantially vertical.

The side arms (18) and (22) of the U-shaped pipe (20) are intended preferably as receivers for either the connecting piece (16) or for L-shaped pipes (24), (28) or a Z-shaped pipe (32) having a Z shape in accordance with FIG. 2.

To provide a pressuretight plug-in connection, an all-round inner groove (34) is provided in the respective side arms (18) and (22), in which groove a snap ring (36) is arranged.

An outer groove (38) associated with the inner groove (34) has the connecting piece (16) or the L-shaped pipe (24), or Z-shaped pipe (32). Here, the inner groove (34) and the outer groove (38) are aligned with one another when the connecting piece (16) or the pipes (24), (28), (32) to be connected are seated correctly in the receiver. In this position, the snap ring (36) snaps partially into the outer groove (38), such that an unreleasable connection is provided between the U-shaped pipe (20) and the connecting piece (16) or connection pipe (24), (28), or (32).

To additionally ensure the necessary pressure tightness, the receiver has a further inner groove (40) in which there is an O-ring (42) in contact with an outer wall of the inserted connecting piece (16) or Z-shaped pipe/L-shaped pipe (32), (24), (28). The inner groove (40) receiving the O-ring (42) is here further away from the opening of the receiver compared with the inner groove (34) receiving the snap ring (36).

The individual pipes (20), (24), (26), (28) of the pipework array (10) of FIG. 1 are now rotatable about axes (44), (46), (48), and (50) that coincide with the longitudinal axes of the receivers and hence the side arms (18), (22) of the U-shaped pipes (20), (26). This rotation or swivel movement is indicated in FIGS. 1 and 2 but the arrows (52), (54), (56), and (58).

As soon as the sprinkler head (13) is aligned with the supply line (14), the previously adjustable pipes (20), (24), (26), (28) or (20), (32) can be fixed relative to one another using headless pins (60). To do so, a headless pin (60) extends from the outer wall of the respective side arm (18), (22) of the U-shaped pipe (20) and can be pressed into the outer wall of the end section—seated in the receiver—of the L-shaped pipe (24) or (28) or Z-shaped pipe (32) or connecting piece (16). The headless pin (60) here runs between the all-round groove (34) receiving the snap ring and the opening of the side arm (18) or (22) of the U-shaped pipe (20).

While in accordance with FIG. 1 the sprinkler head (13) of the pipework array (10) is variable in its distance from the supply line (14), i.e., adjustable both in height and in lateral distance, the pipework in accordance with FIG. 2 permits only a lateral adjustability relative to the supply line, not shown in FIG. 2. This means that an adjustment of the sprinkler head, which is necessary is connected by a telescopic pipe to the Z-shaped pipe (32), is solely about the axes (44) and (46).

As regards the plug-in connections and the design of the pipework according to FIG. 2, the invention provides for the design solutions set forth on the basis of FIG. 1.

What is claimed is:

1. Pipework for a sprinkler system comprising a supply line conveying an extinguishing fluid, a sprinkler head extending from a free end piece, and pipes running between said end piece and a connecting piece extending from said supply line, said pipes being swivelable about first axes parallel to one another and vertical, wherein at least one of said swivelable pipes is a first U-shaped pipe having a first side arm and a second side arm, wherein at least one of said first side arm and said second side arm is a receiver for an end of another one of said swivelable pipes that is connectable in a pressure tight manner to said first U-shaped pipe by a plug-in connection wherein said plug-in connection is a snap-type connection comprising a snap ring, said pipes being swivelable in relation to one another about said first axes when under pressure caused by said extinguishing fluid.

2. Pipework according to claim 1 wherein said first side arm and said second side arm of said first U-shaped pipe are each designed as at least one member of the group consisting of one said receiver for one of said swivelable pipes comprising an L-shaped pipe, a Z-shaped pipe, said end piece, and said connecting piece.

3. Pipework according to claim 1 wherein the receiver has an all-round inner groove, said other one swivelable pipe includes an all-round outer groove, and the snap ring engages regionally in said all-round outer groove when an end of one of said pipes or said connecting piece is seated in said receiver.

4. Pipework according to claim 1 further comprising an all-round inner groove inside said one of said first side arm and said second side arm of said first U-shaped pipe, a sealing element in said inner groove and in sealing contact with an inner wall of said U-shaped pipe or of said connecting piece when said end of said other one swivelable pipe or an end of said connecting piece is locked in said receiver.

5. Pipework according to claim 1 wherein a free end of said first U-shaped pipe or said connecting piece insertable into said receiver is chamfered.

6. Pipework according to claim 1 further comprising a fixing element fixing said first U-shaped pipe or said end seated in said receiver and extending from outside of said receiver and passing through said one of said first side arm and said second side arm between a first inner groove receiving said snap ring and an opening in said one of said first said side arm and said second side arm.

7. Pipework according to claim 1 wherein said pipe connectable in pressure-tight manner to said U-shaped pipe is an angled pipe having an L-shape or is a Z-shaped pipe.

8. Pipework according to claim 7 wherein a free end of said L-shaped pipe snaps into the receiver of the U-shaped pipe.

9. Pipework according to claim 7 wherein one end of said L-shaped pipe snaps into the receiver of the U-shaped pipe and has another free end connected to the sprinkler head.

10. Pipework according to claim 9 further comprising at least one said connecting piece, a second said U-shaped pipe, a second said L-shaped pipe, and said sprinkler head.

11. Pipework according to claim 9 wherein a distance from said supply line to said sprinkler head, aligned vertically or substantially vertically with a longitudinal axis, can be altered by swiveling said pipes both about said first vertical axes and about second horizontal axes.

12. Pipework for a sprinkler system comprising a supply line conveying an extinguishing fluid, a sprinkler head extending from a free end, and swivelable pipes running between said free end and a connecting piece extending from said supply line, said swivelable pipes being swivelable about first axes parallel to one another and vertical, wherein at least one of said swivelable pipes is a first U-shaped pipe with a first side arm and a second side arm, at least one of said first side arm and said second side arm being a receiver for at least one further swivelable pipe that is connectable in pressure-tight manner to said first U-shaped pipe by a plug-in connection designed as a snap-type connection comprising a snap ring, wherein said swivelable pipes comprise at least said first U-shaped pipe and a second U-shaped pipe, and an L-shaped pipe connecting them, wherein said pipes connected by said plug-in connection are swivelable in relation to one another when under pressure caused by said extinguishing fluid, with at least one of said first U-shaped pipe and said second U-shaped pipe being swivelable both about said first axes and about a second axis transverse to said first axes.

* * * * *